US006398589B1

(12) United States Patent
Congelliere

(10) Patent No.: US 6,398,589 B1
(45) Date of Patent: Jun. 4, 2002

(54) DEVICE FOR RESTRICTING OPERATION OF AN ELECTRICAL TOOL

(76) Inventor: Richard A. Congelliere, 12443 W. Lexus Ct., Boise, ID (US) 83713

( * ) Notice: Subject to any disclaimer, the term of this patent is extended or adjusted under 35 U.S.C. 154(b) by 0 days.

(21) Appl. No.: 09/656,689

(22) Filed: Sep. 7, 2000

(51) Int. Cl.[7] ..... H01R 25/00
(52) U.S. Cl. ..... 439/655
(58) Field of Search ..... 439/105, 655, 439/651, 652, 170

(56) References Cited

U.S. PATENT DOCUMENTS

| | | | | | |
|---|---|---|---|---|---|
| 2,265,341 | A | | 12/1941 | Borchert | 173/328 |
| 3,416,123 | A | | 12/1968 | Husebo | 339/37 |
| 3,579,175 | A | * | 5/1971 | Shroyer | 439/105 |
| 4,494,809 | A | | 1/1985 | Soloman | 339/75 P |
| 5,513,998 | A | * | 5/1996 | Kim | 439/170 |
| 5,632,655 | A | | 5/1997 | Demarco, Jr. | 439/655 |
| 5,637,013 | A | | 6/1997 | Weber | 439/502 |

* cited by examiner

*Primary Examiner*—Neil Abrams
*Assistant Examiner*—Phuong KT Dinh
(74) *Attorney, Agent, or Firm*—Robert L. Shaver; Frank J. Dykas; Stephen M. Nipper

(57) ABSTRACT

Disclosed is a device and method for using the device for inhibiting unauthorized usage of a power tool or other electrical component. The device is an electrical adapter or electrical cord having male plugs at each end. The power cord of the tool/component is outfitted with a female receptacle end. Because the tool/component is outfitted with a receptacle (female) end, an unauthorized user cannot plug the tool into a wall outlet (female) unless the user has the invented adapter (double male).

5 Claims, 7 Drawing Sheets

DEVICE FOR RESTRICTING OPERATION OF AN ELECTRICAL TOOL

BACKGROUND OF THE INVENTION

1. Field of the Invention

The present invention generally relates to electrical connections, and more particularly to devices used to restrict operation of an electrical component by preventing unauthorized users from supplying the electrical component with electricity.

2. Background Information

In the United States, electrical components are typically provided with plugs which are intended to be connected into electrical wall receptacles, power strips, or extension cords connecting to said wall receptacles (or power strips).

Both two-wire electrical connections and three-wire electrical connections are common. In a two-wire connection, the plug is usually a two prong type comprising a nonconductive body containing two electrical terminals. An insulated wire containing two separate conductors leads from the plug to the electrical component. One conductor of the wire connects to one prong within the plug body while the other wire connects to the other prong also within the plug body. These two conductors power the device, with one conductor being "hot" and one conductor being "neutral." In a three-wire connection, a third conductor is added as a safety ground.

The typical wall receptacle comprises two sockets containing terminals into which the prongs of the plug are plugged. The receptacle socket terminals are "live," meaning that a voltage exists across them which can be used to power the electrical appliance containing the plug. Hence, when the plug is plugged into the receptacle, circuit continuity is established such that current can flow to the appliance via the hot conductor and return via the neutral conductor. Typically the power supplied to household wall receptacles in the United States is 115 volts, 60 hertz AC, and hence the current flow is of alternating polarity at the AC frequency.

For any of a number of various reasons it may be desirable to control the usage of an electrical component so as to prevent unauthorized use, yet permit authorized use. For example, power tools, such as Skil® saws, are frequently, safely used by properly trained individuals. The problem arises when an untrained individual, particularly children, attempt to use such a tool. Thus, controlling use of such a component is a safety concern, for preventing the use of such devices will prevent countless injuries a year.

The prior art contains a myriad of electrical security devices for preventing unauthorized use and permitting authorized use. A vast majority of prior devices comprise lockouts in which either the plug or the receptacle is physically locked out by means of a locking device which prevents mating engagement of a plug and receptacle. U.S. Pat. No. 3,416,123 is an example of a lockout type device applied to an electrical plug.

Many of these prior lockout devices are key operated and contain a lock mechanism. The authorized user controls the key, and hence it is possible for that person to apply the lock to the plug so that use of the appliance or device containing the plug is prevented until such time as he or she returns with the key to unlock the lock. In order to provide adequate security, such locks must often be of sufficient size and strength so that they may be relatively expensive.

Another prior art device is shown in U.S. Pat. No. 4,494,809 (Soloman). Soloman utilizes a pair of plugs to lock out use. Soloman uses a first adapter which converts the component's plug into another, non-standard plug. This first adapter is secured to the component's plug. Soloman then uses a second adapter which is removable to convert the non-standard plug back into a standard plug which can be plugged into a standard receptacle, such as an wall outlet.

However, Soloman's device can be overcome by an unauthorized user by merely unsecuring the first adapter from the component's plug.

What is needed is a device and method of securing an electrical component so that unauthorized use is prohibited. Such a device/method must be simple, yet not allow an unauthorized user to easily bypass the invented device/method. Such a device/method must work with standard electrical components, including those who need a secure ground connection.

The present invention satisfies these needs.

SUMMARY OF THE INVENTION

The present invention is a safety device and method of using the same. The safety device is for use in electrically connecting a first receptacle with a second receptacle. The safety device has a first plug which is electrically connected to a second plug. The first plug is able to be received into the first receptacle and the second plug is able to be received into the second receptacle. For instance, a power tool could be provided with a power cord having a receptacle instead of a plug. The invented device would then be used to connect the power tool receptacle to another receptacle, such as a wall outlet or an extension cord receptacle.

The method of using the present invention involves first either providing a power tool (or other electrical component) with a receptacle (female) power cord end, or converting an existing power cord plug into a receptacle. The authorized user is then able to connect the invented device between the tool receptacle and the power source receptacle (such as an extension cord or wall outlet). When the authorized user is through using the tool, the authorized user merely needs to detach the invented device and place it in a secure location. Without the invented device, an unauthorized user will be unable to "plug-in" and use the power tool.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
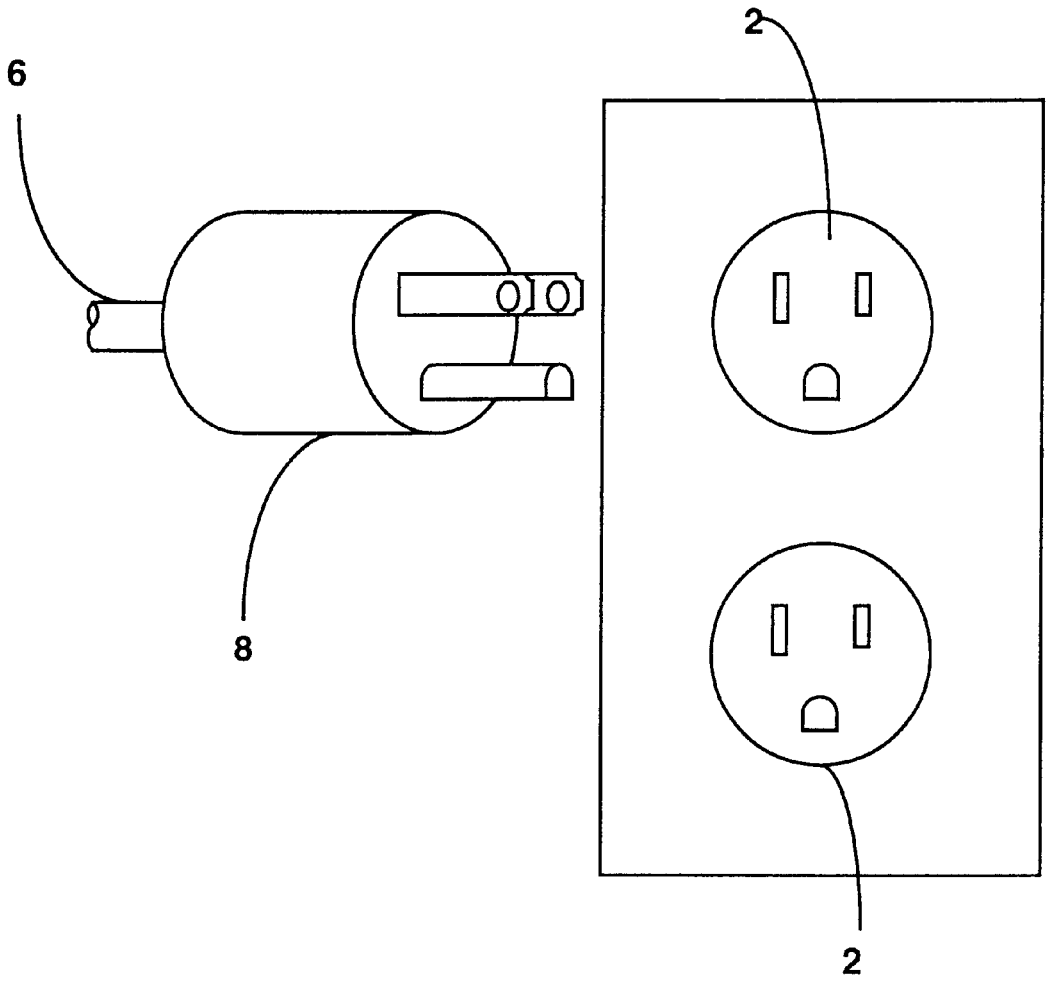
PRIOR ART FIG. 1
FIG. 1 is a view of a prior art plug and receptacle.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Referring initially to FIG. 1, FIG. 1 shows the prior art way of connecting a power tool to an electrical source. The power tool will have a power cord 6 extending therefrom which terminates in a plug 8. This plug 8 is to be plugged into a standard wall socket 2 to power the power tool.

Figure 2:
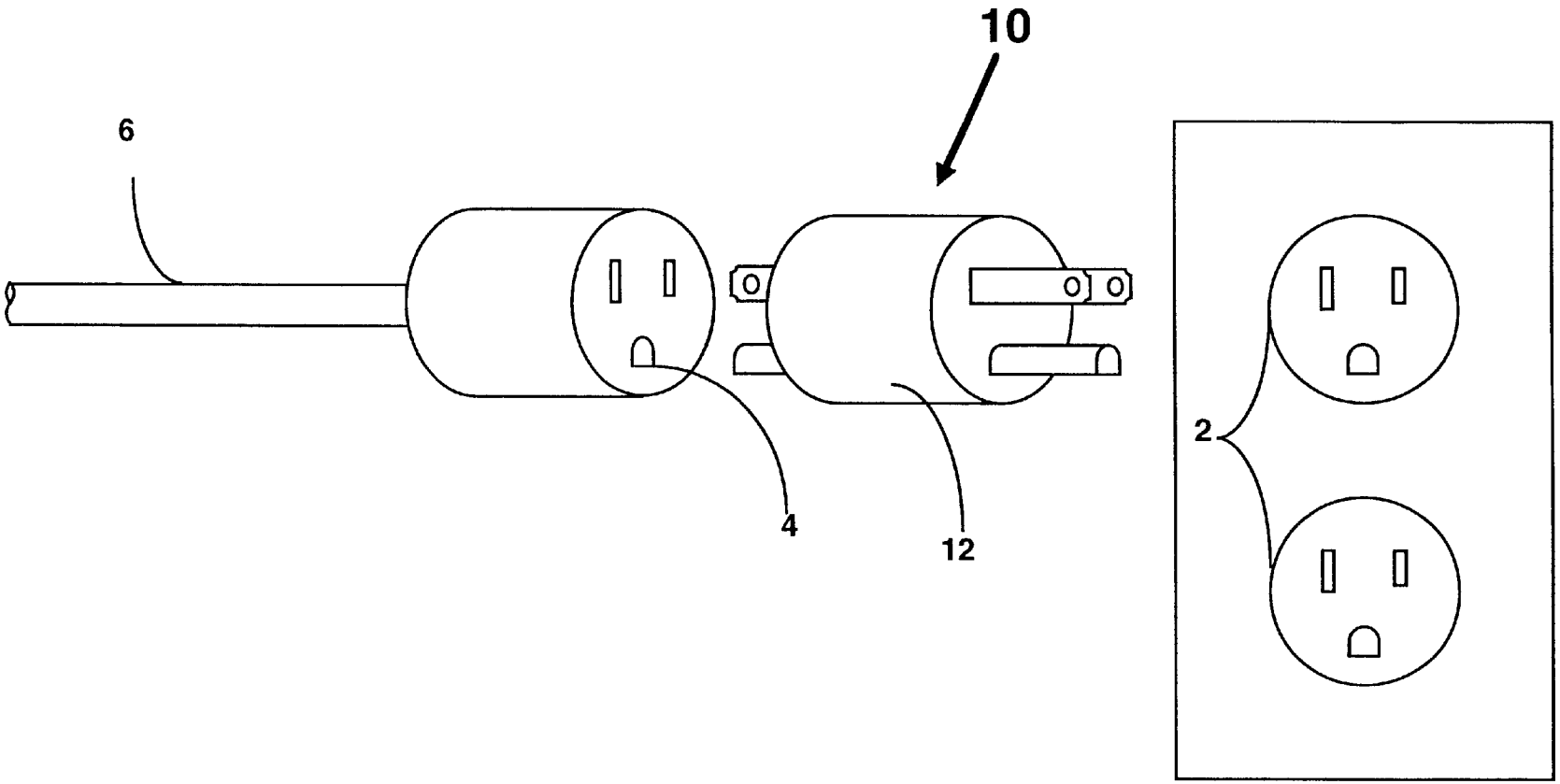
FIG. 2 is an environmental perspective view of a first embodiment of the present invention.

Now referring to FIG. 2, FIG. 2 shows one embodiment of the present invention. The present invention is a safety device 10. The invented safety device 10 is for use with a power tool power cord 6 having a receptacle 4 at the end thereof. The invented safety device 10 comprises a dual male plug which interfits between the second female electrical receptacle 4 and the first female electrical receptacle or wall socket 2.

Figure 3:
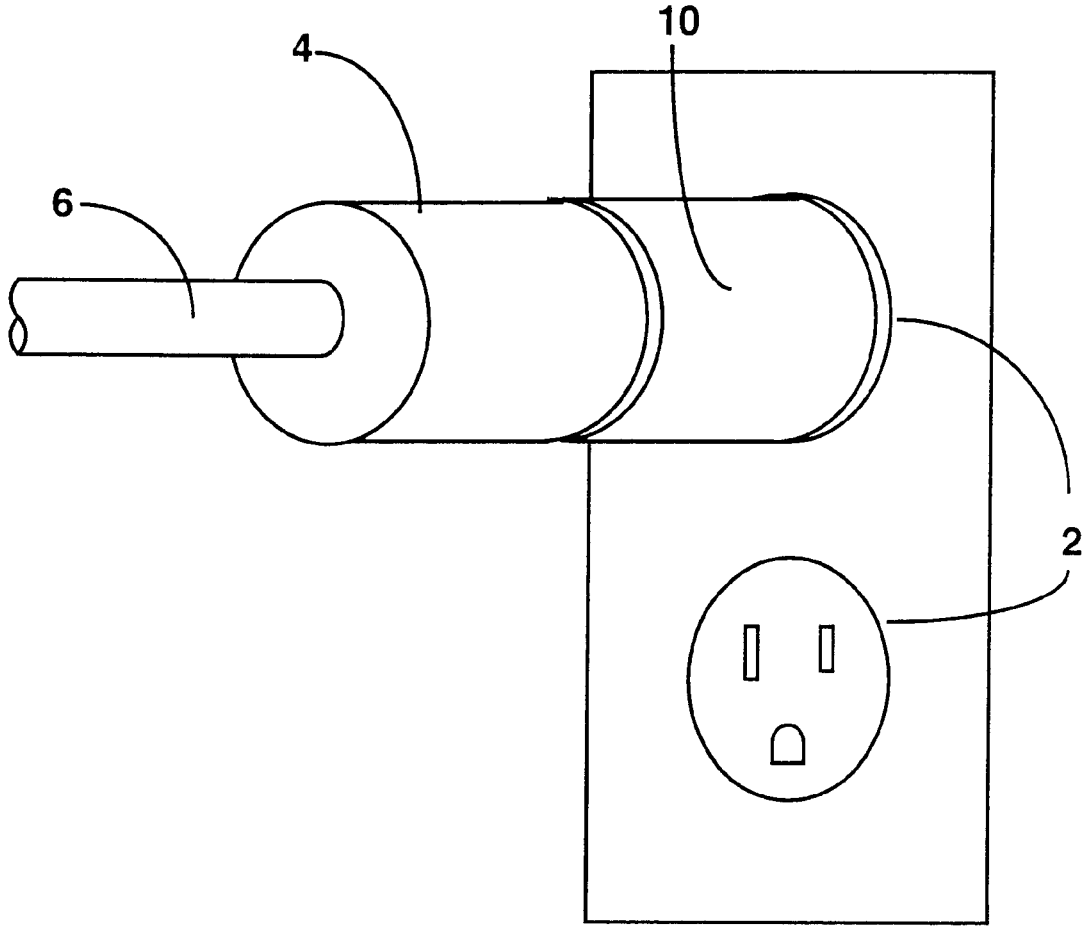
FIG. 3 is a side perspective view of the embodiment shown in FIG. 2, showing the invented device in use.

Referring now to FIG. 3, FIG. 3 shows the safety device of the present invention connected between the wall receptacle 2 and the cord receptacle 4.

Figure 4:
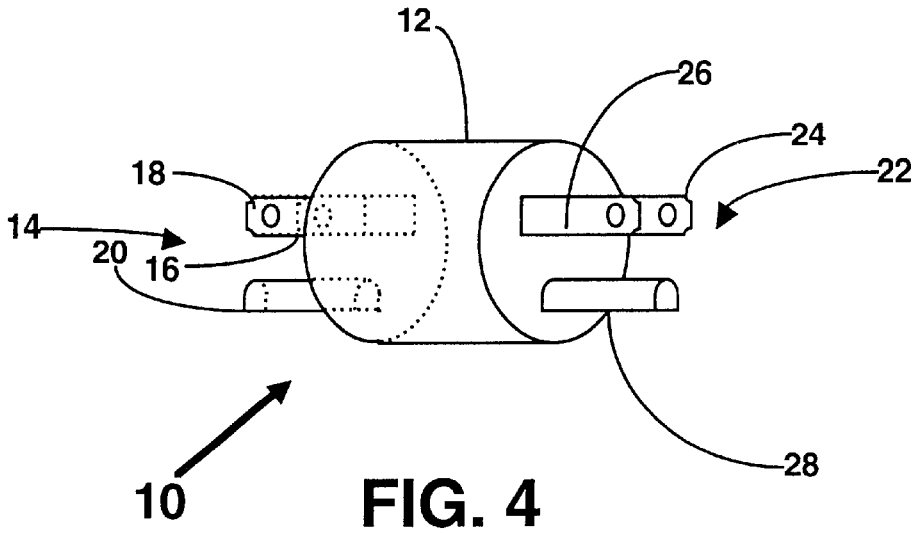
FIG. 4 is a side perspective view of a second embodiment of the present invention.
Figure 5:
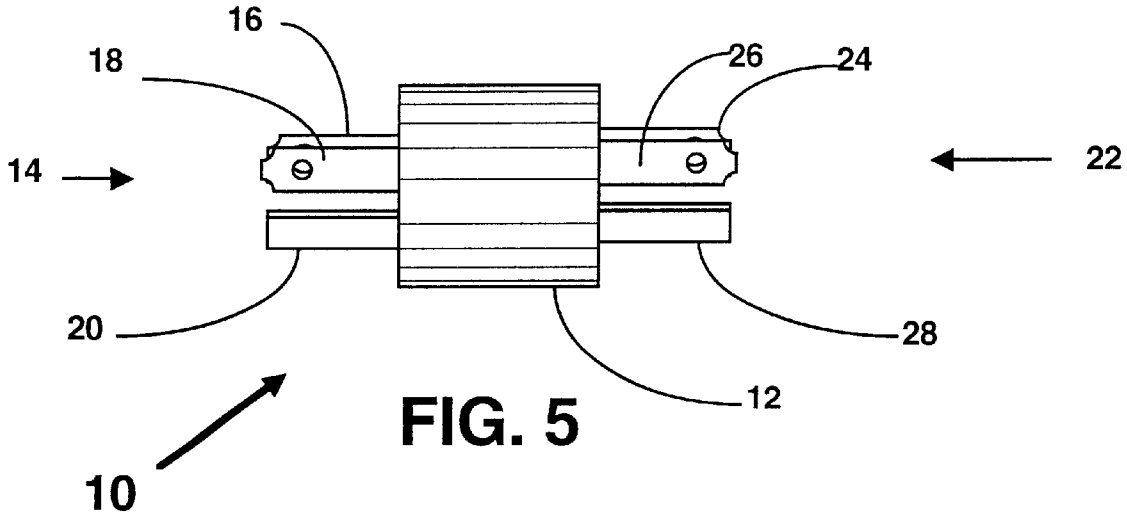
FIG. 5 is a side view of the embodiment of FIG. 4.

FIG. 4 shows a side view of another embodiment of the present invention 10. FIG. 5 shows a perspective view of the embodiment of FIG. 4. In these figures, it can be seen that the invented safety device 10 has an electrical plug body 12 which has a first plug 14 and a second plug 22. The first plug, in this embodiment, has a hot (first) blade 16, a neutral (third) blade 18, and a ground (first) prong 20. Likewise, and interconnected to the same, the second plug has a hot (second) blade 24, a neutral (fourth) blade 26, and a ground (second) plug 28. In such a manner, the plug is electrically able to connect in a standard fashion with a standard electrical connection. While reference is made to the blade 16 being hot, the blade 18 being neutral, and the prong 20 being ground, such descriptions are not intended to be limitations on the plug. Referring to these blades in hot/neutral/ground states is used to simplify the description, and all other powering schemes are envisioned as included.

Figure 6:
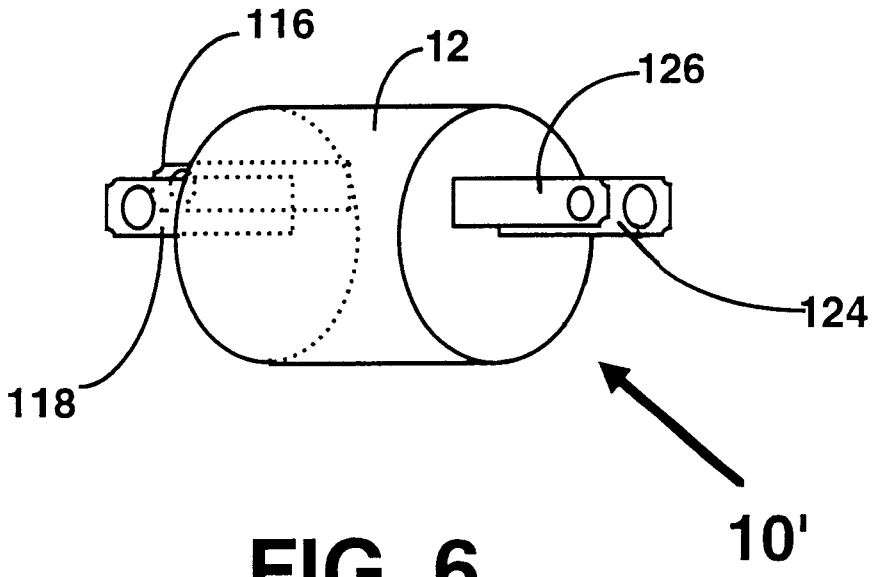
FIG. 6 is a side perspective view of a third embodiment of the present invention.
Figure 7:
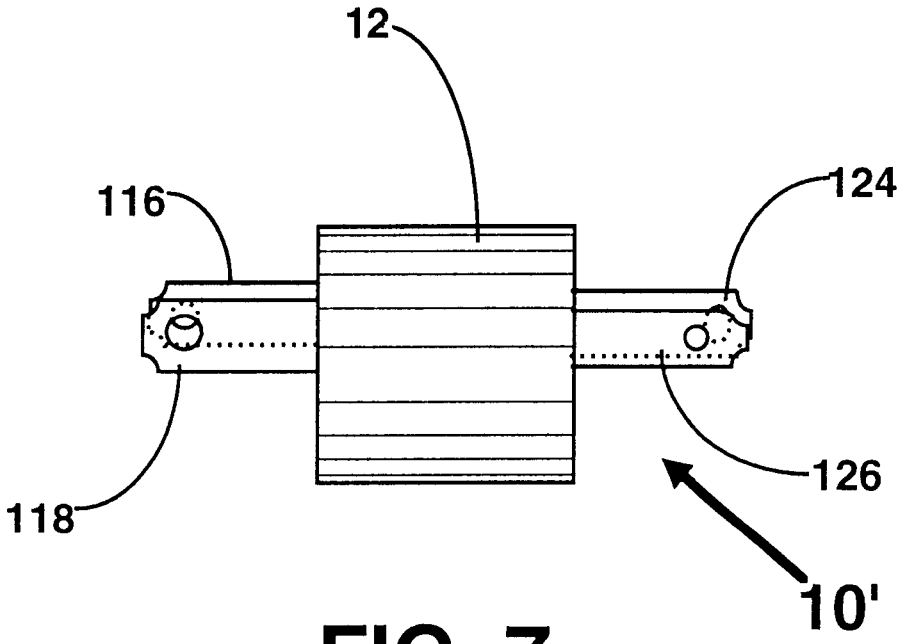
FIG. 7 is a side view of the embodiment of FIG. 6.

Likewise, as shown in FIGS. 6 and 7, it is also envisioned that the invented safety device 10' may comprise a two-prong style connection. In this embodiment, the safety ground prongs 20 and 28 would be absent. Operation of the device 10' would be the same. Also present in such an embodiment would be a hot blade 116, a neutral blade 118, a hot blade 124, and a neutral blade 126.

Figure 8:
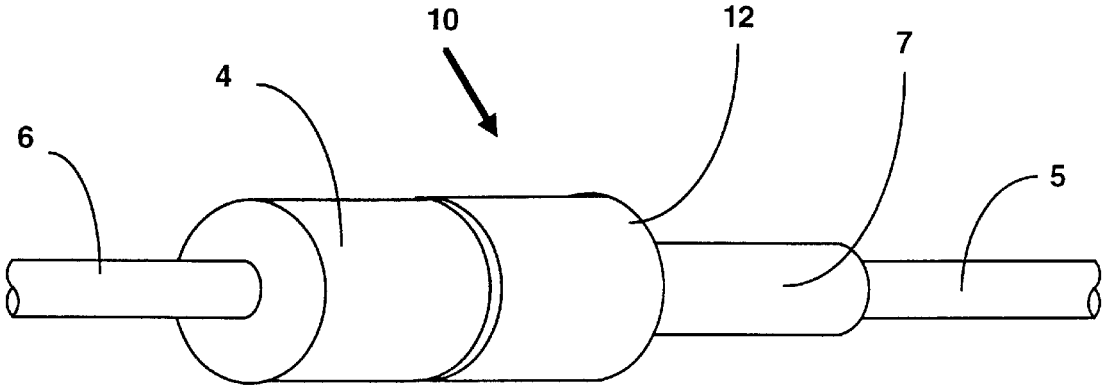
FIG. 8 is a side perspective view of a fourth embodiment of the present invention.

Referring now to FIG. 8, it would also be possible for the invented device 10 to be used in conjunction with an extension cord receptacle 7 of an extension cord 5 rather than in conjunction with the wall socket 2.

Figure 9:
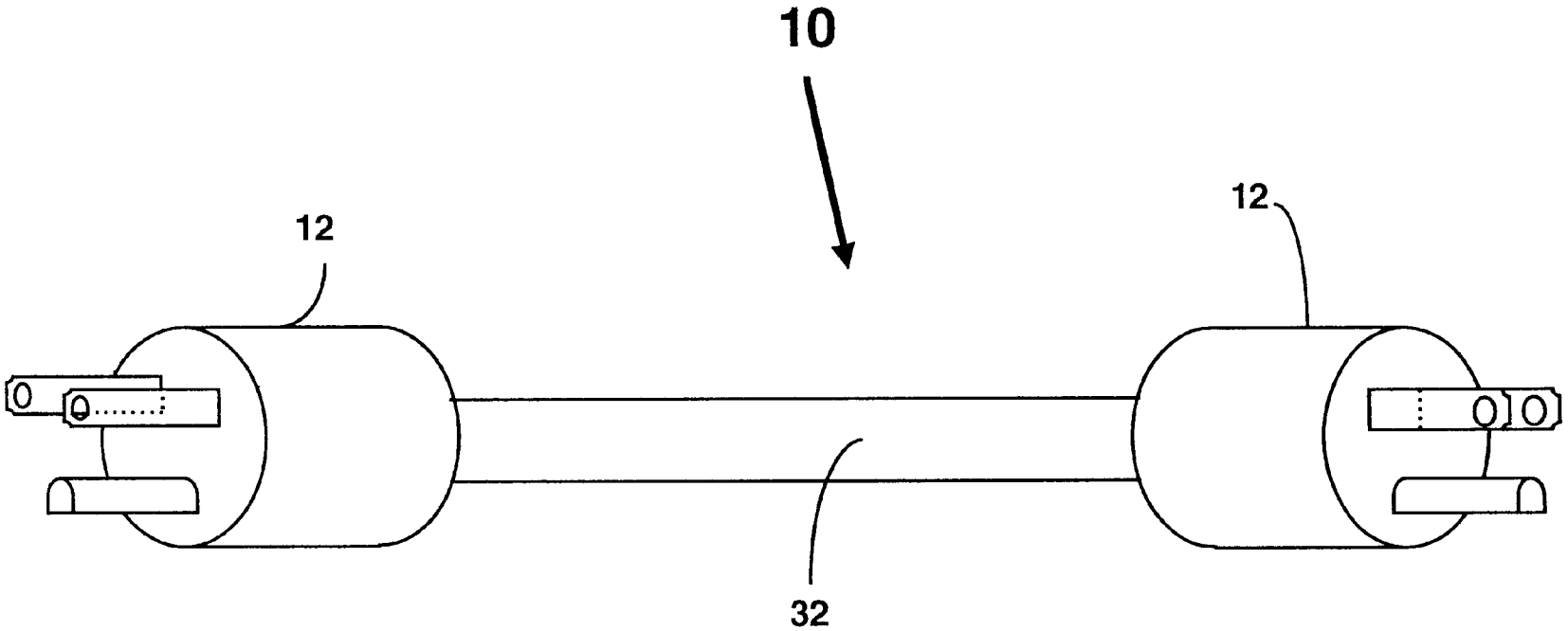
FIG. 9 is a side perspective view of a fifth embodiment of the present invention.

Referring to FIG. 9, it is also envisioned that the present invention may comprise an extension cord style connection 32 rather than having a plug body 12 as in some of the other embodiments.

Use of the present invention involves either providing an electrical tool having a power cord which terminates in a female receptacle or converting the electrical plug of such a power cord into a receptacle. Once the cord has been provided or converted as such, the user merely need use the invented safety device adapter having dual plugs to operate the invented device. In such use, the user would connect the first plug of the present invention into either the wall or the power cord and would likewise connect the second plug of the present invention into the other receptacle. This would allow the power tool to become powered. Upon finishing using the power tool (or other electrical component), the user would merely need to unplug the adapter from both the power tool and the electrical receptacle to contain the power source, and would then be able to securely store the adapter, thereby prohibiting use of the power tool by unauthorized persons.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A method of restricting operation of an electrical tool having a power cord terminating in an electrical plug to be plugged into a first electrical receptacle, wherein said method comprises the steps of:

converting said electrical plug of said power cord to a second electrical receptacle; and providing an adapter having dual plugs, wherein one adapter plug is adapted for electrical connection with said first electrical receptacle, and wherein the other adapter plug is adapted for electrical connection with said second electrical receptacle, thereby electrically connecting said tool to said first electrical receptacle.

2. The method of claim 1 wherein the step of converting said electrical plug comprises removing said electrical plug from said power cord and attaching an electrical receptacle to the power cord.

3. The method of claim 1 wherein the step of converting said electrical plug comprises utilizing an adapter which converts the electrical plug into an electrical receptacle.

4. The system of claim 1 wherein said first electrical receptacle is a wall outlet.

5. The system of claim 1 wherein said first electrical receptacle is the receptacle end of an extension cord.

* * * * *